United States Patent [19]

Lloyd

[11] Patent Number: 4,964,921

[45] Date of Patent: Oct. 23, 1990

[54] METHOD AND APPARATUS FOR CLEANING CHIMNEYS

[76] Inventor: Kerry W. Lloyd, 10919 E. 56th St., Indianapolis, Ind. 46236

[21] Appl. No.: 350,914

[22] Filed: May 12, 1989

[51] Int. Cl.[5] ..... B08B 5/04; A47L 5/12

[52] U.S. Cl. ..... 134/21; 134/22.1; 134/22.11; 15/301; 15/304

[58] Field of Search ..... 15/301, 304; 134/21, 134/22.1, 22.11, 24

[56] References Cited

FOREIGN PATENT DOCUMENTS

| | | | |
|---|---|---|---|
| 147822 | 3/1951 | Australia | 15/301 |
| 447584 | 5/1936 | United Kingdom | 15/301 |
| 657160 | 9/1951 | United Kingdom | 15/301 |
| 672970 | 5/1952 | United Kingdom | 15/301 |

*Primary Examiner*—Asok Pal
*Assistant Examiner*—Ourmazd S. Ojan
*Attorney, Agent, or Firm*—Lundy and Walker

[57] ABSTRACT

A method and apparatus for cleaning chimneys. The method comprises the step of exhausting air up the chimney at a predetermined rate, brushing the flue from the top of the chimney down, loosening dust and both fine and larger particles, exhausting the dust and fine particles with the air, dropping the larger particles into the lower portion of the chimney, and removing the larger particles from the lower chimney portion. The apparatus includes an exhaust fan or blower positioned on the top of the chimney with the inlet thereof being in a sealing relationship with the chimney flue

13 Claims, 3 Drawing Sheets

METHOD AND APPARATUS FOR CLEANING CHIMNEYS

BACKGROUND OF THE INVENTION

The invention relates to a method and apparatus for cleaning chimneys, and more particularly to a method for cleaning chimneys whereby the dust and smaller particles loosened during the cleaning process are exhausted upwardly through the chimney and out the top of the chimney and to an exhaust blower for accomplishing this purpose.

Chimneys have existed for a long time. Homes were originally heated with fireplaces having chimneys. Cook stoves and modern furnaces also have chimneys. Safety requires chimneys to be cleaned periodically. Heretofore chimney flues and fireboxes were cleaned by brushing the walls thereof and dropping both fine particles and larger particles onto the hearth or the bottom of the firebox, letting the dust settle, and then removing the dust and particles from the firebox. Thus, cleaning chimneys in a home, in the past, has caused a great likelihood of creating a very large mess.

Chimney sweeps of the past have taken considerable amount of effort and time to lay drop cloths and erecting a tent around the opening of a firebox in a home to form an enclosure whereby the fine particles and dust from the chimney cleaning operation remain within the enclosure and do not permeate the home and allow the dust to settle on carpets, furniture and other articles within the home. While using drop cloths and tents, properly, most of the particles and dust can be contained therein and successfully removed to the satisfaction of a home owner; however, the entire procedure involves extreme care to accomplish the desired degree of cleanliness.

When using drop cloths and tents to contain the dust and particles removed from a chimney, the chimney sweep is required to work for extended periods of time within the tent and the dusty atmosphere therein. This requires the chimney sweep to wear protective clothing, utilize breathing apparatus and lights, and to work in an atmosphere in which it can be difficult to see at times because of the dust. Because of the dust within these tent enclosures, chimney sweeps have heretofore been highly susceptible to lung diseases from the inhalation of chimney dust.

It is therefore highly desirable to provide an improved method and apparatus for cleaning chimneys.

It is also highly desirable to provide an improved method and apparatus for cleaning chimneys whereby the dust and particulate matter can be controlled in an improved way.

It is also highly desirable to provide an improved method and apparatus for cleaning chimneys in which the chimney sweep need not work in a dust laden atmosphere.

It is also highly desirable to provide an improved method and apparatus for cleaning chimneys in which the time and cost of laying drop cloths and erecting tents to enclose chimney openings can be completely eliminated.

It is also highly desirable to provide an improved method and apparatus for cleaning chimneys in which the chimney sweep need not wear protective clothing or breathing apparatus.

Finally, it is highly desirable to provide an improved method and apparatus for cleaning chimneys which have all of the above features.

SUMMARY OF THE INVENTION

It is therefore an object of this invention to provide an improved method and apparatus for cleaning chimneys.

It is another object of this invention to provide an improved method and apparatus for cleaning chimneys whereby the dust and particulate matter can be controlled in an improved way.

It is another object of this invention to provide an improved method and apparatus for cleaning chimneys in which the chimney sweep need not work in a dust laden atmosphere.

It is another object of this invention to provide an improved method and apparatus for cleaning chimneys in which the time and cost of laying drop cloths and erecting tents to enclose chimney openings can be completely eliminated.

It is another object of this invention to provide an improved method and apparatus for cleaning chimneys in which the chimney sweep need not wear protective clothing or breathing apparatus.

Finally, it is another object of this invention to provide an improved method and apparatus for cleaning chimneys which have all of the above features.

In the broader aspects of this invention there is provided a method and apparatus for cleaning chimneys. The method comprises the step of exhausting air up the chimney at a predetermined rate, brushing the flue from the top of the chimney down with the damper closed, loosening dust and both fine and larger particles, exhausting the dust and fine particles with the air, dropping the larger particles into the lower portion of the chimney, and removing the larger particles from the lower chimney portion. The apparatus includes an exhaust fan or blower which can be positioned on the top of the chimney with the inlet thereof in a sealing relationship with the chimney flue.

BRIEF DESCRIPTION OF THE DRAWINGS

The above-mentioned and other features and objects of this invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
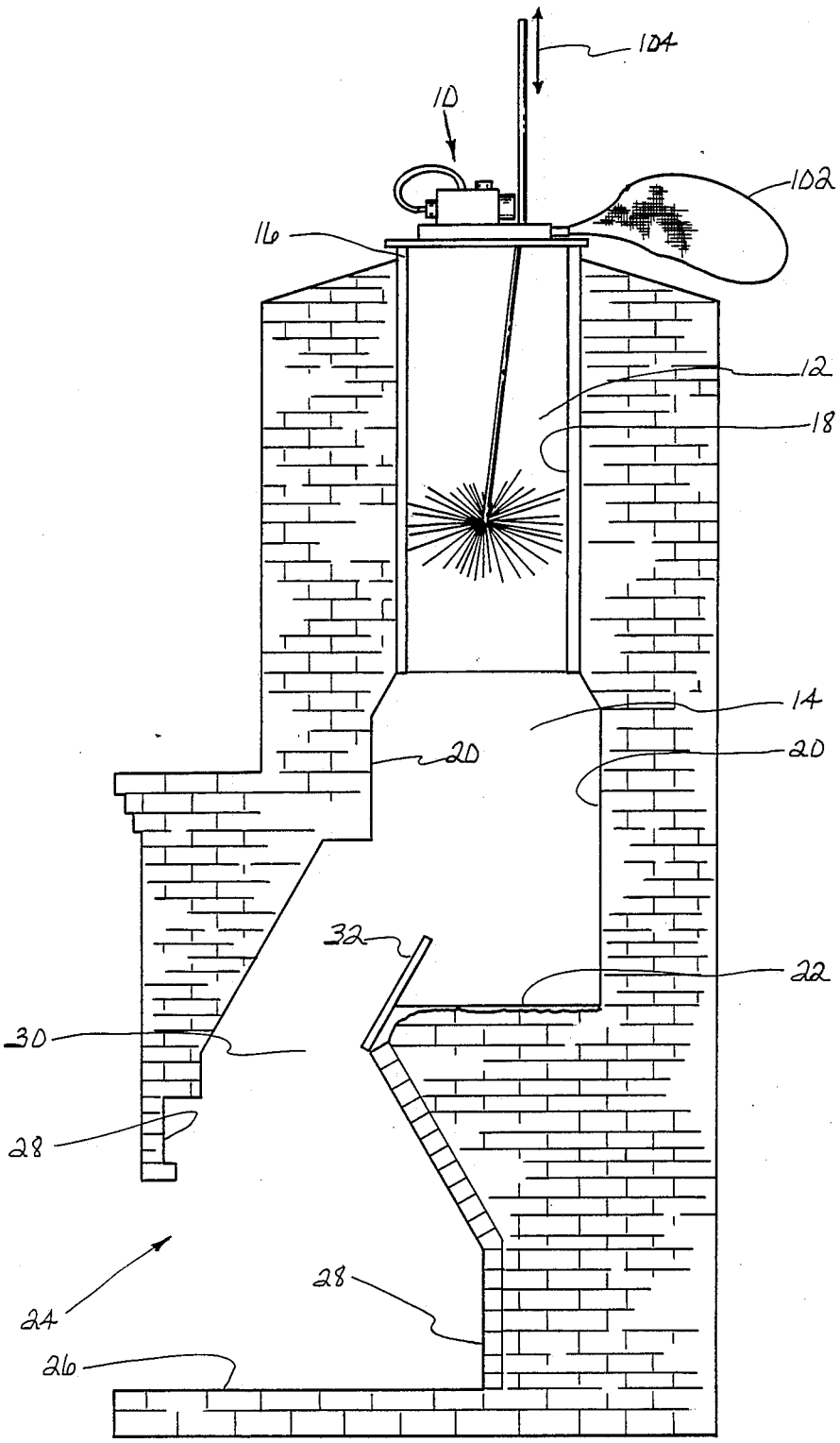
FIG. 1 is a view in cross-section showing a typical chimney with the apparatus of the invention mounted at the top thereof and diagrammatically illustrating the flue brushing procedure.
Figure 2:
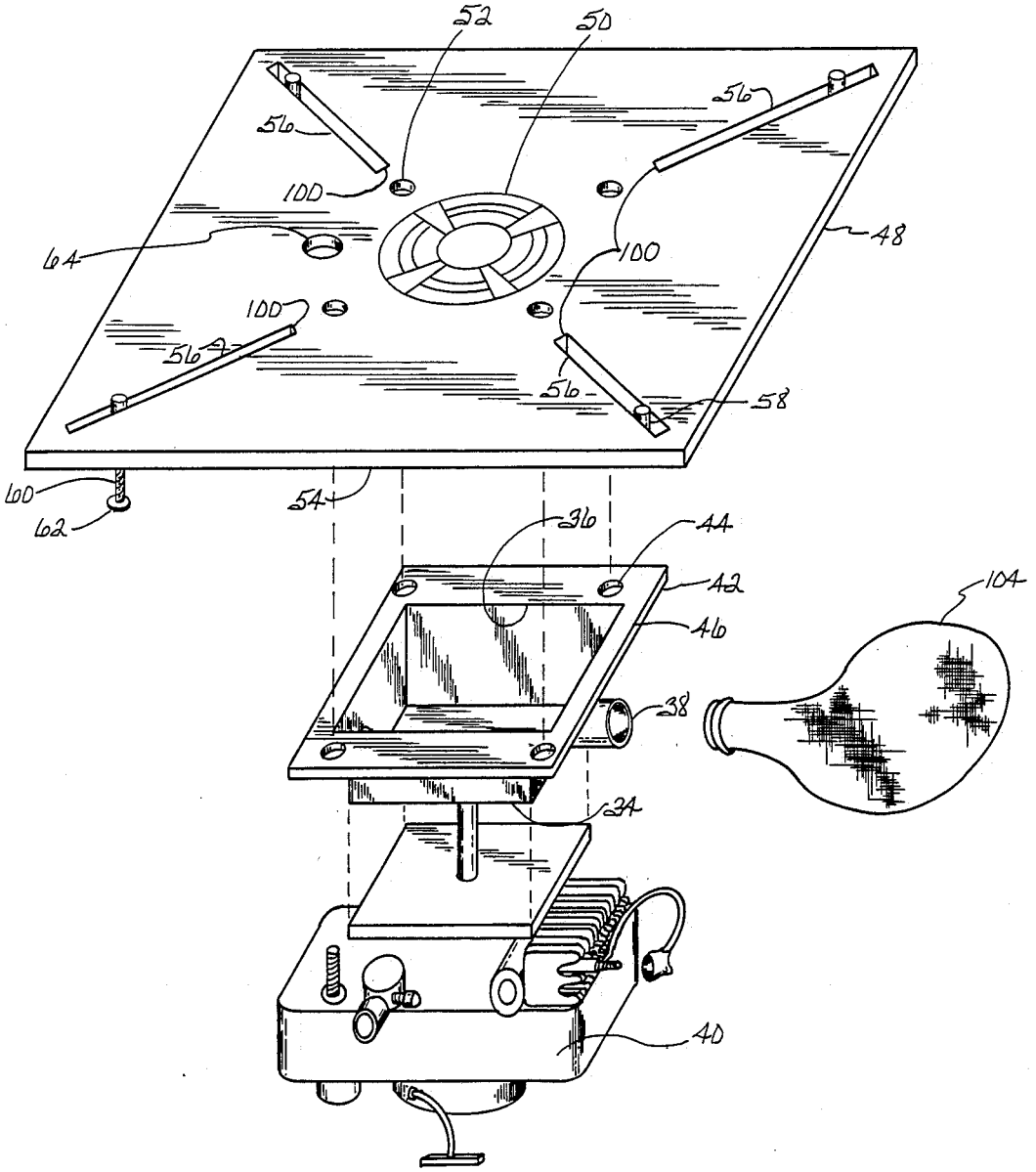
FIG. 2 is a perspective and exploded view showing the base plate and blower of the invention.
Figure 4:
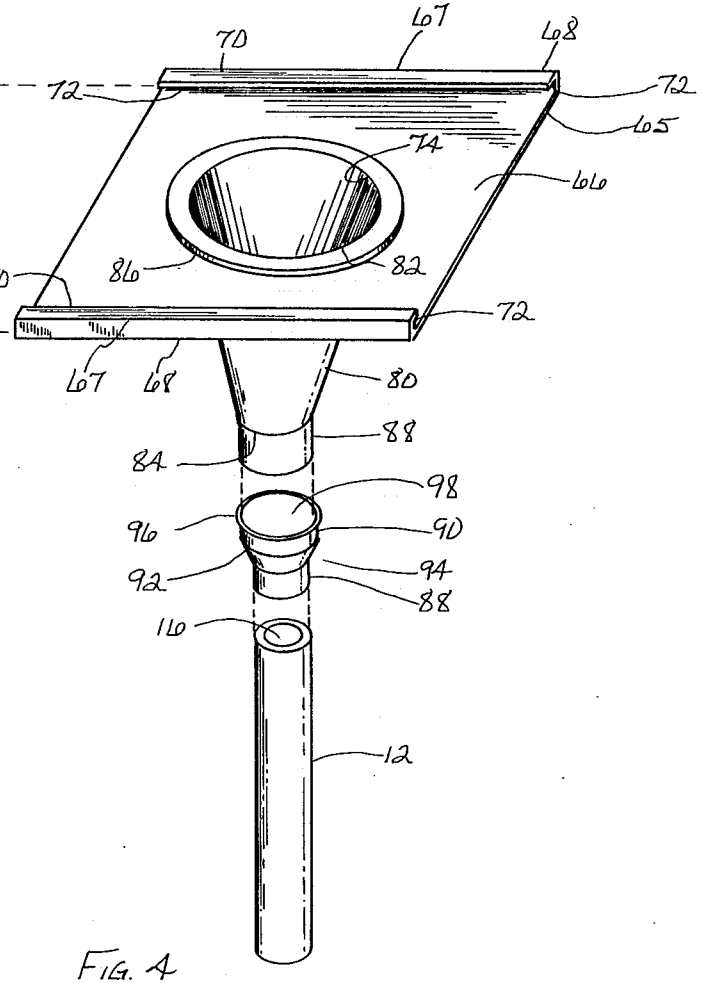
FIG. 4 is a perspective and exploded view showing the base plate, flue adapter and a typical flue pipe.

FIG. 1 illustrates an ordinary brick chimney with the apparatus 10 of the invention mounted at the top of the flue which is useful in describing the method of the invention. A relatively standard chimney has a flue 12 extending from the smoke chamber 14 to the top of the chimney 16. The flue is generally defined by clay tile flue liners 18.

A smoke chamber 14 is located at the bottom of the flue and is generally confined by walls 20 of brick. At the bottom of the smoke chamber is a smoke shelf 22.

Beneath the smoke shelf 22 is a firebox 24. Firebox 24 is defined by a hearth or bottom 26 at the bottom thereof and upstanding walls 28 of firebrick. Extending between the firebox 24 and the smoke chamber 14 is a flue opening 30 which may be provided with a damper 32 selectively opening and closing opening 30.

Both the fireboxes and smoke chambers of conventional brick fireplaces vary in size, as do the flues. Conventional brick fireplaces which have flues lined with clay tile flue liners have flues which range in size from about 8 by 8 inches to about 24 by 24 inches.

Other fireplaces are fabricated and purchased as appliances. These fireplaces and wood stoves and furnaces have smoke chambers and fireboxes which are fabricated of steel and generally have flue openings to which are connected flue pipes. These flue pipes are generally circular in cross-sectional shape and purchased in lengths and assembled at the site. Flue pipe is found in 6 inch diameters through 12 inch diameters. In some of the fabricated fireplaces and furnaces, the smoke chamber is eliminated and the flue is connected directly to the firebox.

The terms "flue" and "firebox" and "smoke chamber" are used herein to include all of the various structures in all of their various sizes, shapes and configurations which function as flues, fireboxes, and smoke chambers. The invention is not limited to any particular shape or size of flue, firebox or smoke chamber.

The Apparatus

The apparatus of the invention comprises a blower or exhaust fan 34 having an inlet 36 and an outlet 38. A motor 40 is mounted on blower 34 and operatively connected to the blower 34 to drive the blower 34. In a specific embodiment, blower 34 and motor 40 can be a 320 cubic foot per minute blower powered by a quarter-horse gasoline engine.

Blower inlet 36 is provided with an inlet flange 42 having mounting holes 44 therein. Flange 42 has a flange seal surface 46 surrounding inlet 36. Blower 34 is mounted to a base plate 48.

Base plate 48 has an intake 50 therein generally centrally located in base plate 48. Intake 50 is smaller in size than blower inlet 36. Surrounding inlet 50 are a plurality of mounting holes 52 which are arranged in size and position to correspond to the size and positioning of mounting holes 44 of flange 42 of blower 34. Blower 34 is mounted to base plate 48 by means of holes 44, 52 and bolts 51 extending therethrough. Base plate inlet 50 is in registry with blower inlet 36 when appropriately mounted.

Base plate 50 has a flat surface surrounding inlet 50 which corresponds to seal surface 46 of flange 42 of blower 34. These two surfaces are held together, with a gasket therebetween if desired, by bolts 51 extending through holes 44 and 52. The seal thus formed is generally annular in shape with its interior size smaller than the cross-sectional size of the chimney flue and the exterior size larger than a cross-section size of the chimney flue.

Radially extending from the inlet 50 are a plurality of slots 56. Extending from each slot 56 is a peg or flue positioner 58 which is connected to base plate 48 by a screw 60, the body of which extends through the slot 58 and is threadedly secured in the peg 58. Both the enlarged head 62 of the screw 60 and the peg 58 is larger in diameter than the width of the slot 56. Thus by loosening and tightening the screws 60, the pegs 58 can be adjusted in position along the slots 56 where desired and secured in place.

Adjacent inlet 50 is a brush hole 64. The purpose of brush hole 64 will be mentioned hereinafter. However, brush hole 64 is within the cross-section of the flue and exterior of the flange 42 of the blower 34 when base plate 48 is mounted on a chimney. In a specific embodiment, base plate 48 can be a steel plate or a sheet of wood as desired.

Base plate 48 with the blower 34 and motor 40 secured together is positioned on the top 16 of the flue 12 prior to conducting the method of the invention. After the chimney is cleaned by the method of the invention, the base plate 48 with the blower 34 and the motor 40 attached thereto is removed from the flue 12.

Figure 3:
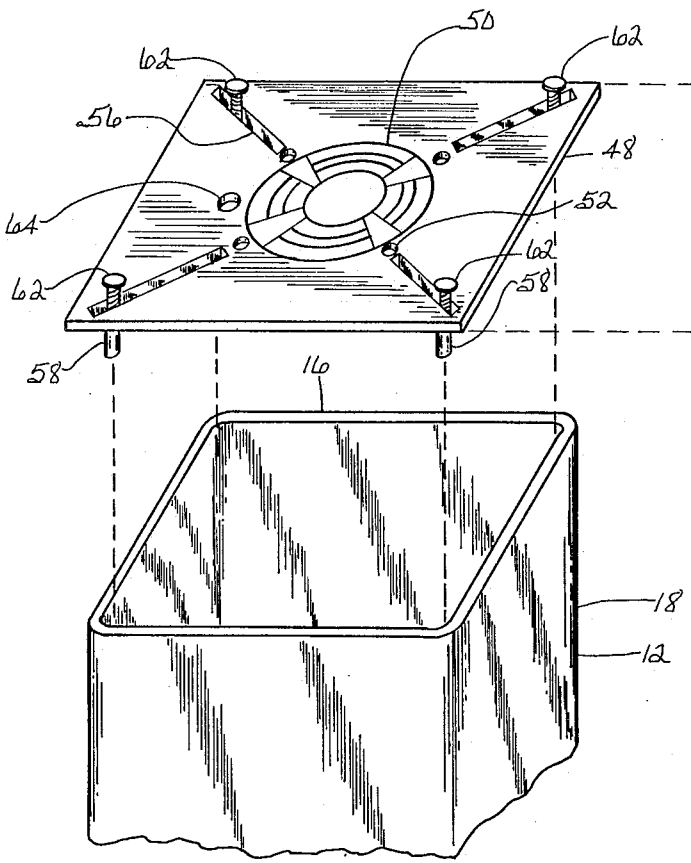
FIG. 3 is a perspective and exploded view showing the base plate and the flue of a typical chimney.

Base plate 48, blower 34 and motor 40 is positioned on a flue comprising clay tile flue liners 18 as shown in FIG. 3. Base plate 48 is positioned on the flue and the pegs 58 are adjusted along slots 56 and secured in place such that a peg 58 is positioned in each of the four corners of the uppermost flue liner 18 adjacent top 16. When this adjustment of the pegs 58 is properly made and the base plate 48 is positioned on the top of the flue 12, the base plate cannot be slid from the top 16 of the flue and is held in place by the pegs 58 and the weight of the blower 34 and the motor 40. The weight of the blower 34 and motor 40 provides a seal between the base plate 48 and the top 16 of the flue 12. Base plate 48 is desirably generally rectangular in shape with an exterior size appreciably larger than the largest flue cross-sectional size. In a specific embodiment, base plate 48 measures 13 inches by 13 inches. Similarly, inlet 50 is appreciably smaller than the smallest size flue; and thus in a specific embodiment, inlet 50 is less than six inches in diameter.

In order to mount base plate 48 with blower 34 and motor 40 attached thereto onto the top 16 of a flue comprising a plurality of interconnected lengths of flue pipe, a base plate flue pipe adapter 65 is required. The adapter 65 is shown to comprise a plate 66 which has a pair of channels 67 on opposite sides thereof. Each of the channels 67 comprises an upstanding wall 68 and a flange 70. The flange 70 extends from the wall 68 over plate 66 and overlies plate 66 defining a flange opening 72. Flange openings 72 extend end to end of plate 66 and face each other.

Located in the center of plate 66 is an opening 74. Opening 74 is larger than base plate intake 50. Opening 74 is always large enough to enclose intake 50 and brush opening 64 when appropriately positioned on base plate 48. Plate 66 has a width dimension between flange walls 68 sufficient to receive base plate 48 therebetween. Opposite peripheries of base plate 48 are positioned within channels 67 when properly positioned and base plate 66 and flanges 70 overlay opposite sides of base plate 48. When adapter 65 is properly positioned on base plate 48, opening 74 surrounds base plate intake 50 and encompasses both base plate intake 50 and brush hole 64.

Secured to adapter 65 and depending therefrom is a conical reducer 80. Reducer 80 has opposite ends 82 and 84. End 82 is generally the same size as opening 74 and has a flange 86 extending radially outwardly thereof. Reducer 80 is positioned in opening 74 with flange 86 overlaying plate 66 between channels 67. Flange 86 and the corresponding underlaying surface of plate 66 forms a seal between reducer 80 and plate 66. End 84 of reducer 80 is connected to a cylindrical section 88 which extends co-axially from end 84 of reducer 80. Reducer 80 and cylindrical section 88 can be formed of sheet metal and connected together in accordance with good sheet metal practice. Cylindrical member 88 is sized to fit into the top 16 of the top flue pipe section of the largest size to be used. The largest readily available size of flue pipe is 12 inches in diameter. Thus, with cylindrical portion 88 being slightly less than 12 inches in size, portion 88 can be fit into the uppermost section of the flue pipe of the largest size with top 16 abutting the exterior surface of cylindrical reducer 80 in a tight fit.

A reducer 90 is required to connect a flue pipe of a smaller size to the adapter 65. Reducer 90 also is similar to reducer 80 as it has both a conical section 92, an inlet 94 and a cylindrical inlet section 88 connected to inlet 94. Reducer 90 however also has a cylindrical outlet section 96 connected to outlet 98 opposite of inlet section 88. Cylindrical portion 96 is always slightly larger than cylindrical portion 88 of reducer 80 such that it can fit over and be superimposed on portion 88 in a tight-fitting frictional relationship.

Cylindrical portion 88 of reducer 90 is sized to fit within the uppermost flue pipe section at top 16 of a variety of sizes. Thus, a reducer 90 will be sized to fit each available size of flue pipe. In specific embodiments, portion 88 of a reducer 90 is sized to fit within the end opening of 8 inch round flue pipe, 10 inch round flue pipe and 6 inch round flue pipe.

Adapter 90 like reducer 80 can be manufactured from sheet metal and made in accordance with existing sheet metal techniques such that adapter 65 can be fitted to flue pipes from 6 inches to 12 inches in diameter in an appropriate sealing relationship between base plate 48, adapter 65, reducer 80, adapter 90 and flue pipe sections.

In a specific embodiment of adapter 65 and base plate 48, pegs 58 can be removed from base plate 48 whenever base plate 48 is desirably positioned within flange openings 72 of adaptor 65 or base plate 48 can be removed from flange 42 and inverted whereby pegs 58 upstand in the direction of blower 34 and motor 40 rather than depending from base plate 48 thereby presenting to adapter 65 a generally planar surface for sliding into complimentary relationship with the surface of plate 66 between opposed channels 67.

Larger adapter plates 66 are provided for larger flues. Since these are only used occasionally, bolts instead of channels 67 are used for attachment to base plate 48.

The Method

The method of the invention comprises placing the blower 34 and motor 40 attached to the base plate 48 on the top 16 of the flue of the chimney to be cleaned. If the flue is defined by clay tile flue liner 18, the pegs 58 are adjusted on the base plate 48 and placed within the upper flue liner 18 with the base plate 48 resting on top 16 of the flue 12 and the pegs being in the respective corners of the flue liner as above described. The motor is then started and exhaust fan or blower 34 exhausts air through the outlet 38 into a filter bag 102 causing an updraft in the flue and firebox of the fireplace. If the flue is equipped with a damper which blocks air flow, the damper is opened. Blower 34 and motor 40 exhausts air from the firebox. If the chimney is in a home, air is exhausted from the home, into the firebox, up the flue through the filter bag and out into the atmosphere. In a specific embodiment, the filter bag can be a conventional waste bag or other vacuum bag.

If the flue is defined by lengths of flue pipe, the adapter is connected to the top 16 of the flue pipe by means of the reducer 80 with or without a reducer 90 depending upon the size of the flue pipe, and the engine is started causing an updraft flow from the firebox through the flue 12, through the filter bag and into the atmosphere. This causes air to be exhausted through the firebox, up the flue, from the building in which the stove, furnace, or fireplace is located.

The flue is cleaned with a flue brush. The flue brush rod is positioned through the opening 64 in the base plate 48 and the flue brush is moved in an up and down motion as indicated by the arrows 100 in FIG. 1. The brushing is continued from the top 16 down into the smoke chamber. Generally, the smoke chamber is cleaned from the bottom; and thus, the brushing need only continue to the top of the smoke chamber. By this brushing, dust and small and large particles are loosened from the sides of the flue. Both the dust and the smaller particles are exhausted with the air, the larger particles are dropped onto the smoke shelf and the damper or into the firebox. Of course, if there is no damper in the chimney or no smoke chamber, particles will drop into the firebox or onto the hearth.

Once the flue is cleaned, the smoke chamber is cleaned by brushing from the bottom of the flue to the smoke shelf by brushing the walls of the smoke chamber. Again, the brushing loosens both dust and particles. The air being exhausted by the blower 34 exhausts both the dust and the smaller particles with the air. The larger particles drop onto the smoke shelf or into the firebox or onto the hearth. Once the smoke chamber is cleaned, the smoke shelf and damper are cleaned by brushing the larger particles into the firebox. Again, the dust and the smaller particles are exhausted with the air. The larger particles fall into the firebox or onto the hearth.

The firebox is then cleaned by brushing all of the walls of the firebox up to the damper. This also causes dust and particles to be loosened from the firebox walls. The dust and the smaller particles are exhausted with the air, the larger particles fall onto the hearth. Finally, all of the particles are removed from the hearth. This can be done by a vacuum.

In this description, the term "smoke shelf" is used to describe the bottom of the smoke chamber and the term "hearth" is used to describe the bottom of the firebox. Whether the firebox is in a furnace, stove or fireplace, these terms are used consistently. The term "hearth" is used consistently throughout. In the case where the furnace, stove or fireplace does not have a smoke chamber, the furnace, stove or fireplace also does not have a smoke shelf.

All of the cleaning by the method of this invention can be accomplished by the chimney sweep not wearing protective clothing or using breathing apparatus. As the exhausting of air through the flue is sufficient to carry with it all dust and fine particles. Only the larger particles are not exhausted with the air and those are dropped onto the smoke shelf or the hearth can be removed by a brush and dust pan or a vacuum, quite easily.

The cleaning of the flue, the smoke chamber and the walls of the firebox can be accomplished by conventional flue brushes which are cylindrical in shape.

A gasoline motor-driven blower 34 having a capacity of 320 cubic foot per minute is adequate for chimneys having 289 square inches in cross-sectional area or less. In the smaller chimneys, such a blower is adequate for the practice of the invention at part-throttle.

In a specific embodiment, the filter bag can be a conventional waste bag or other vacuum bag.

While there have been described above the principles of this invention in connection with specific apparatus and method, it is to be clearly understood that this description is made only by way of example and not as a limitation to the scope of the invention.

What is claimed is:

1. A method of cleaning chimneys comprising steps of exhausting air up the chimney at a predetermined rate, cleaning the flue of said chimney by brushing said flue, loosening dust and both small and larger particles from said flue, exhausting said dust and small particles with said air, dropping said larger particles into the lower portion of said chimney, cleaning said lower portion of said chimney by brushing, loosening dust and both small and larger particles from said lower portion, exhausting said dust and small particles from said lower portion with said air, dropping said larger particles onto the bottom of said lower portion, and removing said particles from said lower portion.

2. The method of claim 1 further comprising cleaning the smoke chamber of said chimney by brushing, loosening dust and both small and larger particles from said smoke chamber, exhausting said smoke chamber dust and small particles with said air, dropping said larger smoke chamber particles onto the smoke shelf at the bottom of said smoke chamber, and removing said larger particles from said smoke shelf.

3. The method of claim 1 further comprising cleaning the firebox and hearth of said chimney by brushing, loosening dust and both small and larger particles from said firebox and hearth, exhausting said firebox dust and small particles with said air, dropping said firebox larger particles onto said hearth and removing said larger firebox particles from said hearth.

4. The method of claim 1 wherein said flue brushing is accomplished by inserting a cylindrical flue brush into said flue and raising and lowering said brush within said flue.

5. The method of claim 1 wherein said exhausting step is accomplished by placing an exhaust fan on top of said chimney, and providing a seal between the inlet of said exhaust fan and said chimney.

6. The method of claim 5 wherein said exhaust fan has a capacity of exhausting air up to a rate of 320 cubic feet per minute.

7. The method of claim 5 wherein the exhaust of said fan exits into a filter bag.

8. Apparatus for cleaning chimneys comprising a blower having an inlet and an outlet, a motor operably connected to said blower to drive said blower, a base plate secured to said inlet, said base plate having an intake therein, said intake being in registry with said blower inlet, said base plate having a seal surface around said plate intake, said plate intake being smaller than the cross-sectional size of a chimney flue, said seal surface being annular in shape with its interior size being smaller than said cross-sectional size of said flue and its exterior size being larger than said flue cross-sectional size, and a flue brush rod hole in said base plate spaced from said inlet and within said seal surface and said flue cross-section when said inlet is in registry with said flue.

9. The apparatus of claim 8 further comprising a filter bag, wherein said blower outlet is connected to said filter bag, said bag being air permeable, the exhaust of by said blower empties into said bag.

10. The apparatus of claim 8 wherein said base plate has flue positioners thereon, said positioners extend outwardly from said base plate in the direction opposite of said blower, said positioners engage said chimney to position said inlet in registry with said flue.

11. The apparatus of claim 8 further comprising a flue adapter, said flue adapter having an inlet and an outlet, said inlet being sized to sealing engage a flue, said adapter being attachable to said base plate, said outlet being in registry with said base plate inlet when said adapter is attached to said base plate.

12. The apparatus of claim 11 wherein said adapter outlet is circular.

13. The apparatus of claim 8 wherein said blower is capable of creating an upwardly flowing draft in a flue greater than minimal naturally occurring drafts.

* * * * *